US006662383B2

(12) United States Patent
Cornelius et al.

(10) Patent No.: US 6,662,383 B2
(45) Date of Patent: Dec. 16, 2003

(54) POOL LINER PERIMETER ASSEMBLY

(75) Inventors: Kerry J. Cornelius, St. Catherines (CA); Josephine S. Cosgrave, St. Catherines (CA)

(73) Assignee: North American Pool Company, St. Catharines (CA)

( * ) Notice: Subject to any disclaimer, the term of this patent is extended or adjusted under 35 U.S.C. 154(b) by 0 days.

(21) Appl. No.: 09/994,474

(22) Filed: Nov. 26, 2001

(65) Prior Publication Data

US 2003/0033665 A1 Feb. 20, 2003

(30) Foreign Application Priority Data

Aug. 17, 2001 (CA) ..... 2355556

(51) Int. Cl.[7] ..... E04H 4/00
(52) U.S. Cl. ..... 4/506
(58) Field of Search ..... 4/503, 506; 52/169.7

(56) References Cited

U.S. PATENT DOCUMENTS 3,177,501 A * 4/1965 Kwake ..... 4/503 X
3,644,941 A 2/1972 Kuss
3,975,782 A * 8/1976 Lankheet ..... 4/506 X
5,018,324 A * 5/1991 Lankheet ..... 52/169.7
5,107,551 A * 4/1992 Weir et al. ..... 4/506 X
6,076,201 A 6/2000 Peterson

* cited by examiner

*Primary Examiner*—Charles E. Phillips
(74) *Attorney, Agent, or Firm*—Harness, Dickey & Pierce, P.L.C.

(57) ABSTRACT

The invention relates to a pool liner assembly that comprises a main liner subassembly and a secondary liner subassembly. The main liner subassembly comprises a main liner sheet for lining the walls of a pool, and a main liner clip attached to the top edge of the main liner sheet for attaching the main liner subassembly to a coping of the pool. The secondary liner subassembly comprises a secondary liner sheet overlapping an upper portion of the main liner sheet and having a bottom edge that is attached to the main liner sheet, and a secondary liner clip attached to the top edge of the secondary liner sheet, for attaching the secondary liner subassembly to the coping of the pool. The secondary liner subassembly may be attached to the front or back of the main liner subassembly. After the portion of the assembly facing the sun has faded, it can be removed to reveal an fresh underlying portion of the assembly.

6 Claims, 11 Drawing Sheets

POOL LINER PERIMETER ASSEMBLY

FIELD OF THE INVENTION

This invention relates generally to swimming pools and in particular to a vinyl pool liner assembly attachable to a swimming pool.

BACKGROUND OF THE INVENTION

Three common liner materials for swimming pools are plaster, fibreglass, and polyvinyl chloride (PVC). All three materials have respective advantages and disadvantages. For example, plaster is relatively easy to apply to the swimming pool and is durable; well maintained plaster lined pools have been known to last for up to 20 years. However, plaster tends to stain easily, and the surface can break down if not maintained regularly. Fibreglass is relatively inert, is less susceptible to staining than plaster, and is non-porous. However, fibreglass is brittle and can be difficult to apply.

PVC lined pools, commonly known simply as vinyl-lined pools, are relatively new to the North American pool industry. Lining the walls of a pool with vinyl liner sheets typically involves first laying a fibre blanket over the pool's walls; the blanket allows the vinyl liner to contract and expand with the underlying pool structure. Then, vinyl sheets stored on rolls are unrolled and installed over the blanket with each sheet secured to each other by an adhesive.

Unlike fibreglass, vinyl liners are flexible, and thus are compliant to movement of the concrete foundation of the pool. The vinyl material can be formulated to resist swimming pool chemicals and can contain antibacterial and antifungal agents. However, one major drawback of vinyl liners is that over time, the walls of the liner, particularly the upper portion of the liner above the water line of a filled pool, become faded due to weathering and exposure to sun light. Typically, such unsightly faded pool liners are simply replaced, even though they may still be structurally sound.

Several examples of previously patented arrangements are as follows:

U.S. Pat. No. 4,601,073 Methot of Jul. 22, 1986 discloses a vinyl-lined swimming pool coping having a PC liner and a PVC snap cap for protecting the liner from sunlight.

U.S. Pat. No. 4,713,849 Kindness of Dec. 22, 1987 discloses a pool liner retainer having an upper peripheral edge that is formed with a greater thickness of vinyl material then the rest of the liner.

U.S. Pat. No. 5,083,327 Gillebaard of Jan. 28, 1992 shows a portable, above ground swimming pool that is constructed to be less susceptible to sunlight.

U.S. Pat. No. 3,839,748 Stillman, Jr. of Oct. 8, 1974 discloses a swimming pool coping having a panel extending downwardly to overlap the top of the liner for protecting the liner from sunlight.

U.S. Pat. No. 6,076,201 Peterson of Jun. 20, 2000 discloses a protective covering for an inflatable swimming pool for improving durability; and U.S. Pat. No. 3,644,941 Kuss of Feb. 29, 1972 discloses a swimming pool liner with each corner of the liner having a thermal barrier intermediate the liner and the sidewalls for preventing ice damage.

None of the above mentioned specifications disclose the unique combination of the present invention which utilizes a main liner sheet and a secondary liner sheet heat sealed or otherwise suitably connected thereto with the top edge of the main liner sheet and the protective or secondary sheet being detachably connected to a coping of a swimming pool perimeter. The liner material can be manufactured from a beaded vinyl material and the second or protective liner may extend part way or completely downwardly to the bottom of the main liner sheet.

SUMMARY OF THE INVENTION

According to one aspect of the invention, there is provided a pool liner assembly that comprises a main liner subassembly and a secondary liner subassembly, The main liner subassembly comprises a main liner sheet for lining the walls of a pool, and a main liner fastener at the top edge of the main liner sheet for fastening the main liner subassembly to a coping of the pool. The secondary liner subassembly comprises a secondary liner sheet overlapping an upper portion of the main liner sheet and has a bottom edge that is attached to the main liner sheet, and a secondary liner fastener at the top edge of the secondary liner sheet, for fastening the secondary liner subassembly to the coping of the pool.

The main liner sheet and secondary liner sheet may be made from a vinyl material. Further, the bottom edge of the secondary liner sheet may be attached to the main liner sheet by a heat seal. Also, the secondary liner sheet may have a width that is substantially the same as the main liner sheet, and a depth that is at least 15 inches. Further, the main and secondary liner fasteners may be flexible clips for clipping to respective tracks of the coping.

The secondary liner sheet may be attached to the front or back surface of the main liner sheet. If the secondary liner sheet is attached to the back surface of the main liner sheet, the secondary liner sheet is positioned such that an upper portion of the main liner sheet covers the secondary liner sheet. After exposure to sunlight has faded this portion of the main liner sheet, it can be cut away from the assembly to reveal the freshly exposed secondary liner sheet. If the secondary liner sheet is attached to the front surface of the liner sheet, it serves as a protective covering for the main liner sheet portion covered by the secondary liner sheet.

DETAILED DESCRIPTION

Figure 1:
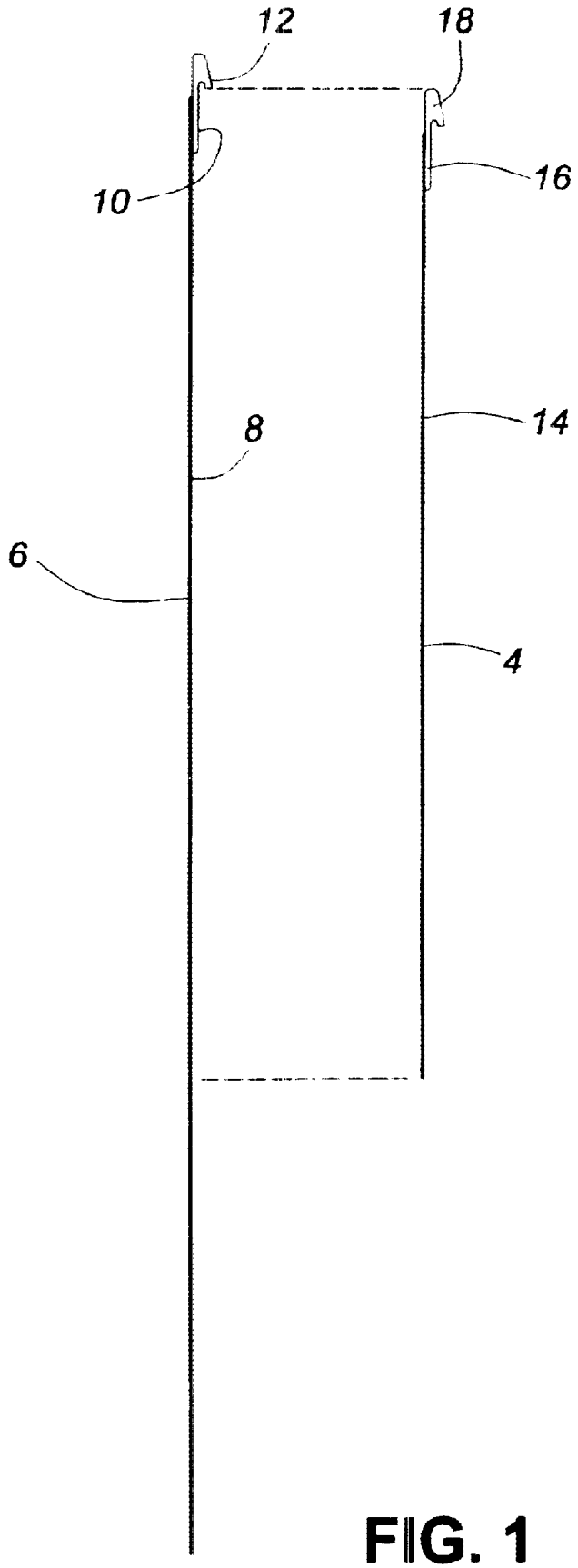
FIG. 1 is an end view of a pool liner assembly having a main liner subassembly separated from a secondary liner subassembly, according to an embodiment of the invention.
Figure 2:
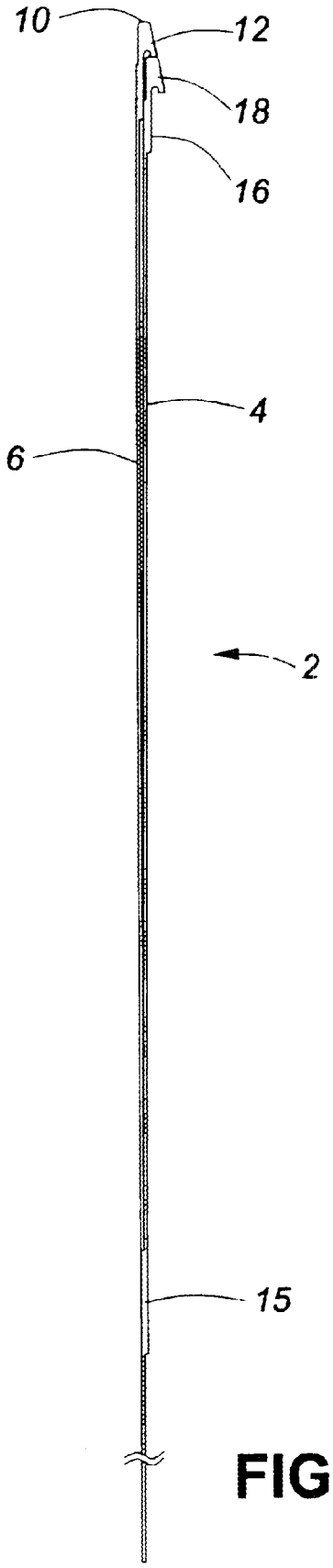
FIG. 2 is a side view of the pool liner assembly of FIG. 1 wherein the main liner subassembly and the secondary liner subassembly are joined by a heat seal.
Figure 3:
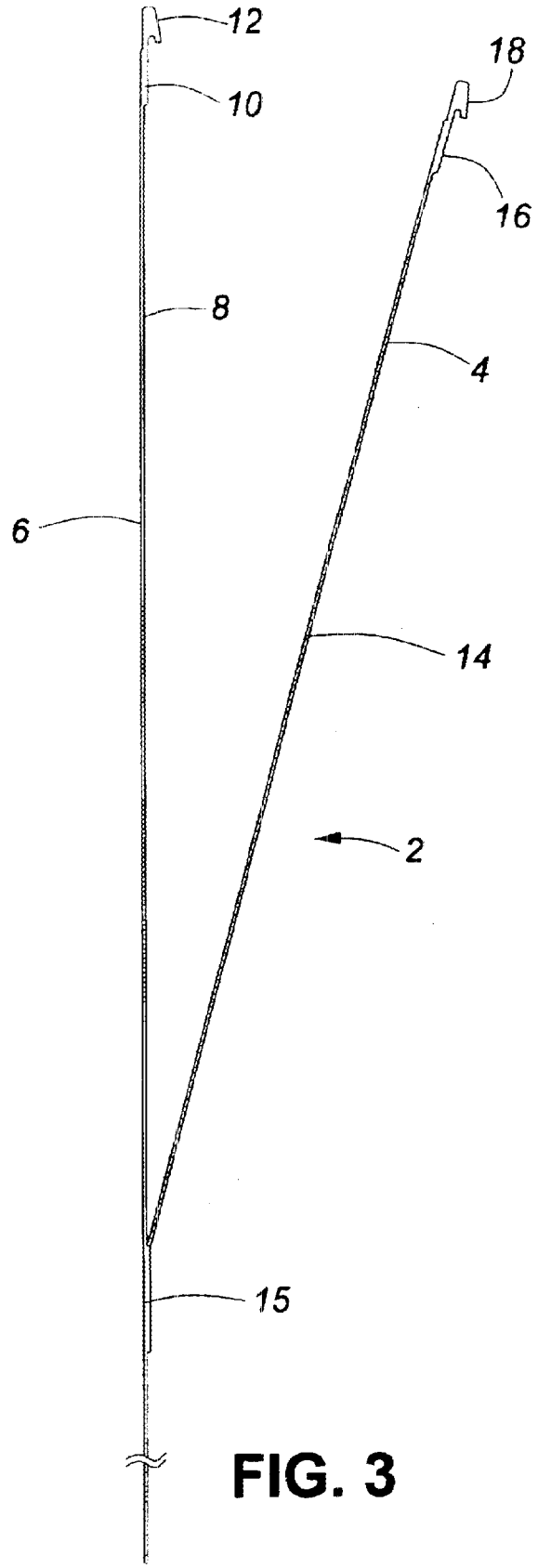
FIG. 3 is a side view of the pool liner assembly of FIG. 1 wherein the main liner subassembly and the protective liner subassembly are joined by a heat seal, and wherein the secondary liner subassembly is bent away from the main liner subassembly.

Referring to FIGS. 1 to 3 and according to one embodiment of the invention, a pool liner assembly indicated generally at 2 includes a main liner subassembly 4 and a secondary liner subassembly 6. The secondary liner subassembly 6 is attached to the main liner subassembly 4 such that the secondary liner subassembly 6 overlaps at least the upper portion of the main liner subassembly 4. The secondary liner subassembly 6 overlaps the front of the main liner subassembly 4 and thus serve as a protective covering for the covered portion of the main liner subassembly 4. The secondary liner subassembly may overlap the back of the main liner subassembly 4; in either case, the overlapping or sunshade portion of the liner subassembly may be cut away after it has faded and worn out, leaving the remainder of the liner subassembly 4 still attached to the pool wall coping.

The main liner subassembly 4 includes a main liner sheet 8, the size and shape thereof being dependent on the size of the pool to be lined. The main liner sheet 8 may comprise a plurality of individual sheets joined together by an adhesive or other conventional means, and is defined herein to include enough individual sheets to line the side walls of the pool. The main liner sheet 8 is preferably made of a beaded vinyl material, such as poly vinyl chloride (PVC). Along the top edge of the main liner sheet 8 is attached a main liner clip 10, secured to the main liner sheet 8 by a suitable adhesive or by other conventional means. The clip 10 is made of a flexible material and has a hook 12 at its distal end and is adapted to detachably connect liner sheet 8 to the coping of the pool.

The secondary liner subassembly 6 includes a secondary liner sheet 14 that is also made of a beaded vinyl material, such as PVC. Along the top edge of the secondary liner sheet 14 is attached a secondary liner clip 16. The clip 16 is of a similar design to the main liner clip 10 and as such, is attached to the top edge of the secondary liner sheet 14 by an adhesive or other conventional means, is made of a flexible material and has a hook 18 at its distal end for detachable connection to the coping on a pool wall.

The secondary liner sheet 14 has dimensions that are selected to cover at least the upper portion of the main liner sheet 8, and as such, has a width that relates to the depth of the main liner sheet 8, (depth on the pool wall) depending on the amount of protective coverage desired. For example, the secondary liner sheet 14 may have a depth of 15 to 18 inches, which is usually deep enough to overlap the portion of a main liner sheet 8 above the water line of a filled pool. However, the depth of the secondary sheet 14 may extend several feet or all the way to the bottom of the pool, if greater overlap is desired. The amount of secondary sheeting 14 selected will depend in part on material costs and desired coverage.

As shown in FIGS. 2–5, the secondary liner subassembly 6 is attached to the main liner subassembly 4 by heat sealing the bottom edge of the secondary liner sheet 14 to either the front or back surface of the main liner sheet 8. Preferably, a heat seal 15 extends along the bottom edge of the secondary liner sheet 14, so that a water tight seal is formed between the two sheets 8, 14.

Figure 4:
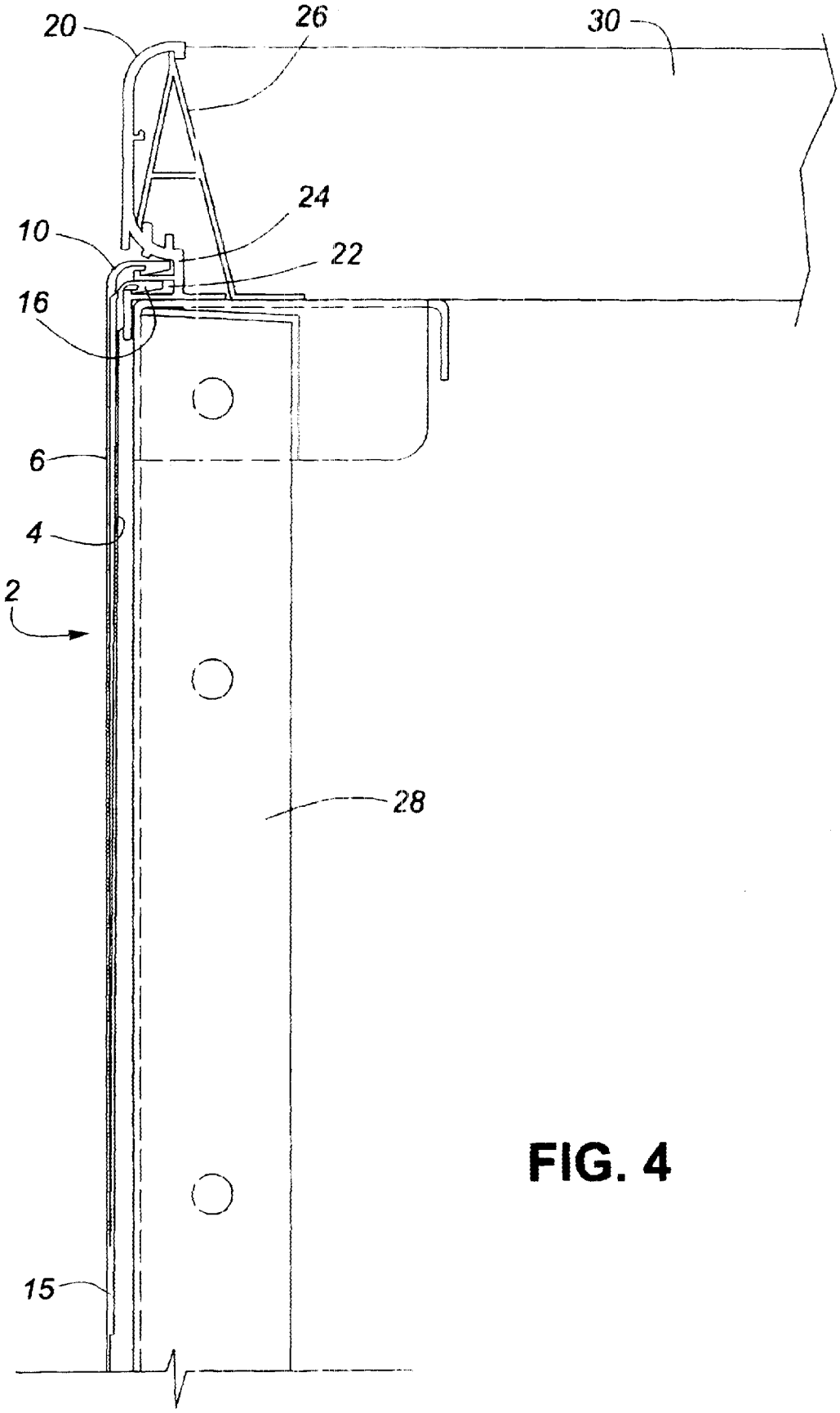
FIG. 4 is a cross-sectional view of a portion of the pool liner assembly of FIG. 1 attached to a coping of a swimming pool.
Figure 5:
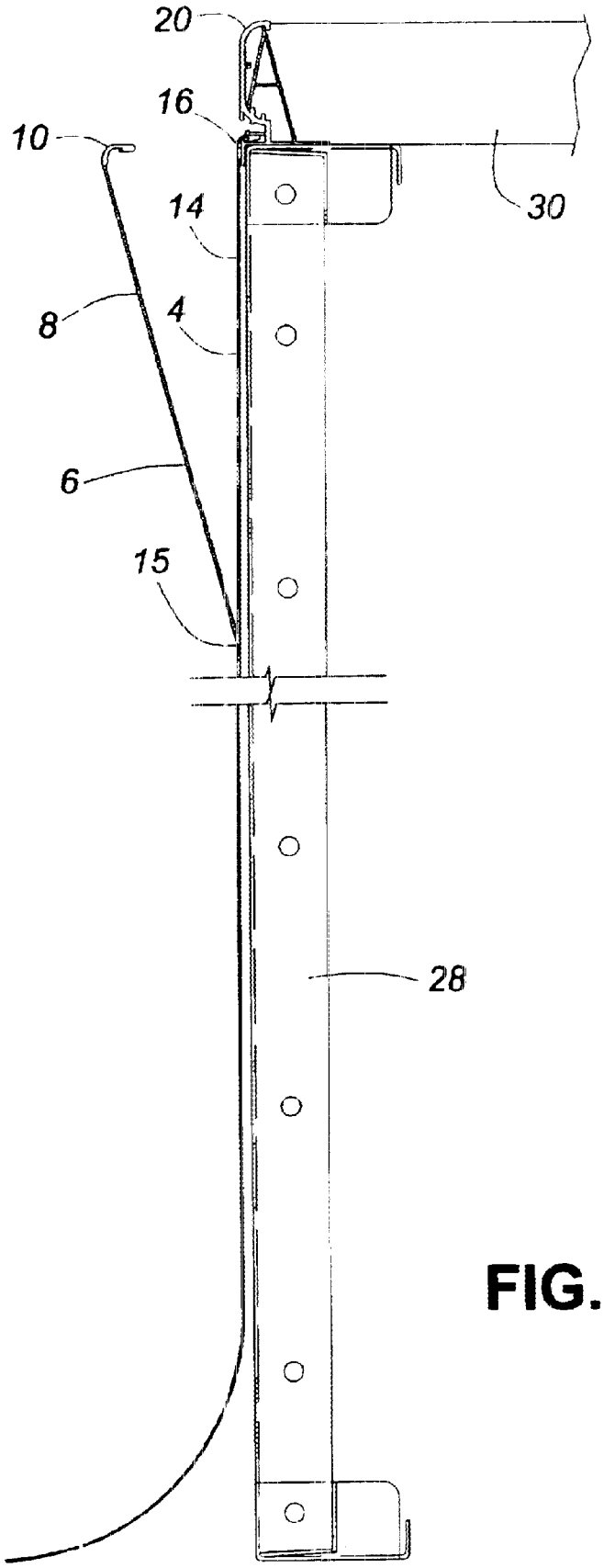
FIG. 5 is a cross-sectional view of a portion of the pool liner assembly of FIG. 1 attached to a coping of a swimming pool, wherein a portion of the main liner subassembly is bent away from the secondary liner subassembly.

In an embodiment wherein the secondary liner subassembly 6 is attached to the back of the main liner subassembly 4, the secondary liner assembly 6 is positioned over the main liner subassembly 4 such that the main liner clip 10 extends above the secondary liner clip 16 a distance sufficient for both clips 10, 16 to bend and to fit into respective tracks 22 and 24 of a swimming pool coping 20. Referring to FIGS. 4 and 5, the coping 20 is made of plastic and is attached to a flange 26 at the rim of a swimming pool. The flange 26 is attached to the rim of the pool formed by the intersection of a concrete ledge 30, and a steel side wall 28.

As seen in FIG. 4, the coping 20 has formed on its outer, pool-side surface a pair of tracks for accepting the clips 10, 16 of the pool liner assembly 2, namely, bottom track 22 and top track 24. Each track 22, 24 has an upwardly-extending lip that cooperates with and is engaged by the hook 12, 18 of each clip 10, 16 when the clips 10, 16 are inserted in the tracks 22, 24. The clips 10, 16 are held in place by the downwards-pulling weight of the pool liner assembly 2, which causes the distal ends of the clips to abut against the track walls, and the hooks 12, 18 to abut against the track ledges. The track material is sufficiently pliant that unweighting the clips 12, 16 and pulling the proximal ends upwards will free the clips 12, 16 from the tracks 22, 24.

After lengthy exposure to the elements and in particular to sunlight, the exposed or sunshade portion of the liner will wear out and fade. The useful life of the pool liner assembly 2 is extended by the provision of the secondary liner and the aesthetic appearance of the pool liner assembly 2 is extended by removing the outer, overlapping portion of the liner and exposing the fresh underlying liner.

According to one embodiment of the invention, the secondary liner subassembly 6 is laid in front of the main liner subassembly 4, so that the secondary liner subassembly 6 serves as a protective covering for the overlapping portion of the main liner subassembly 4. The secondary liner subassembly 6 is positioned over the main liner subassembly 4 such that the secondary liner clip 16 extends above the main liner clip 10 and clips into the top track 24 of the coping 20. Again, a heat seal 15 is used to attach the two subassemblies 4, 6 together. After the secondary sheet 6 has faded or worn out, it can be cut away, leaving a freshly exposed main liner subassembly 4.

FIGS. 6 through 11 illustrate the manner in which the overlapping portion of the exposed liner subassembly has its liner clip removed from the top track 22 and the outer liner sheet is cut away from the main sheet, as close as possible along the heat seal 15.

Figure 6:
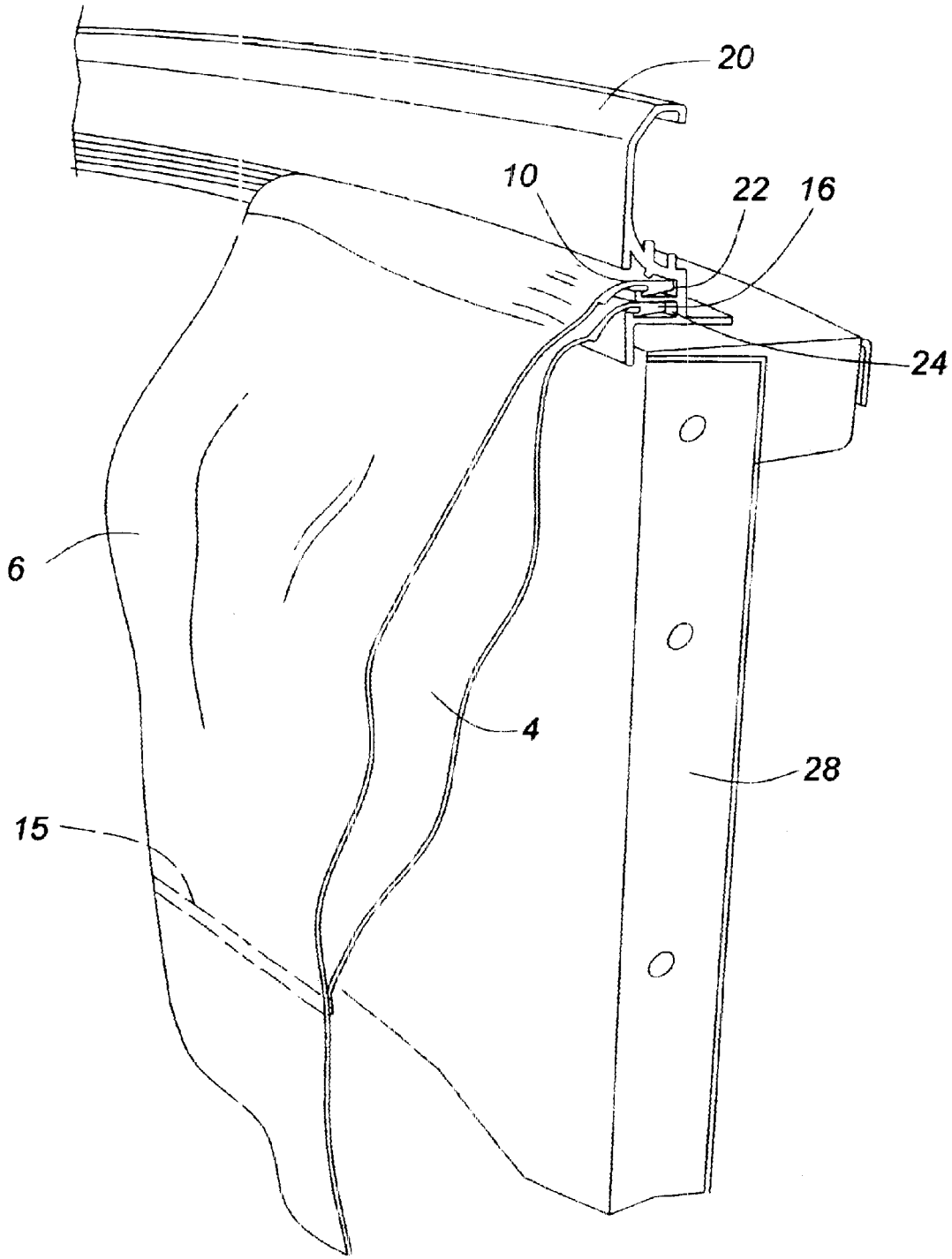
FIG. 6 is a fragmentary perspective view showing the main liner assembly and the secondary or protective liner assembly having their upper ends connected to the coping of the pool.
Figure 7:
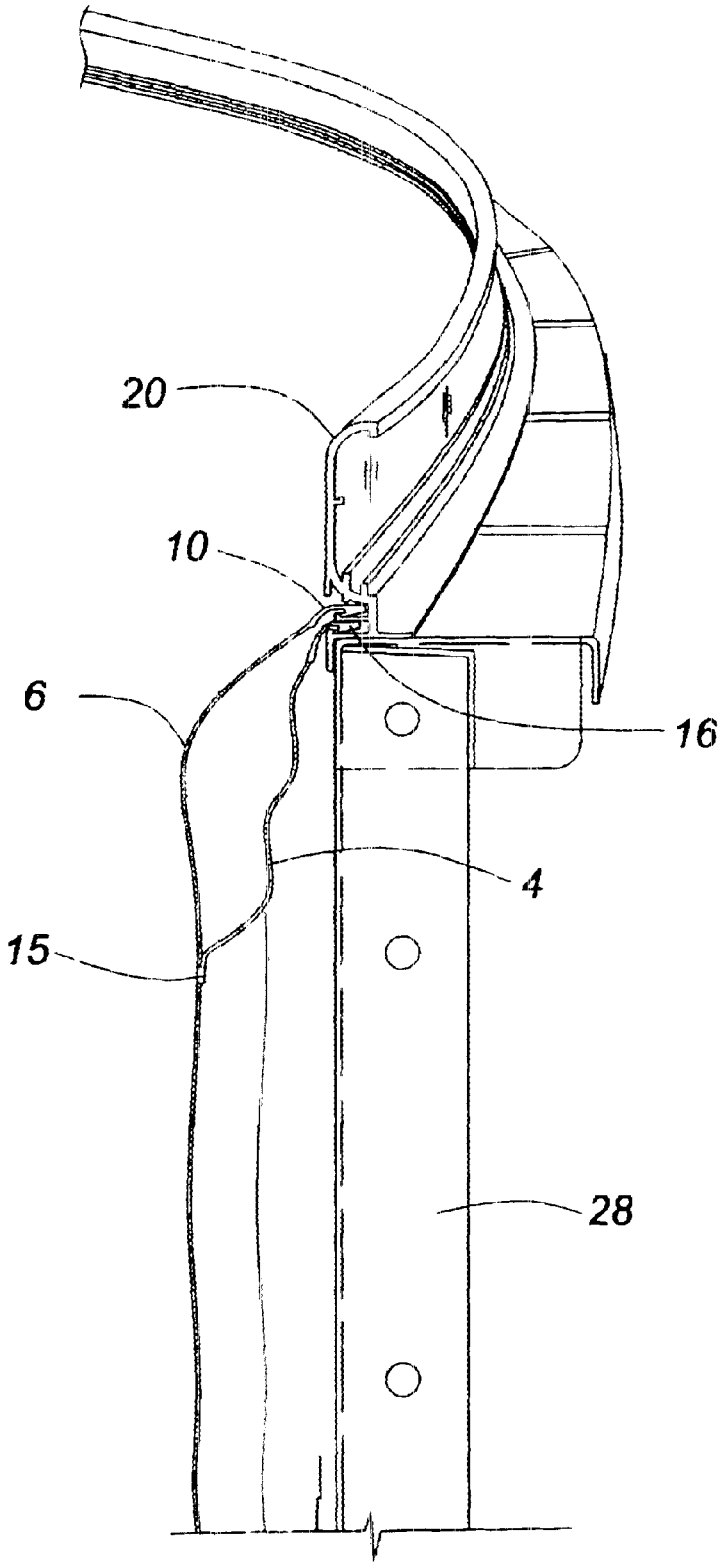
FIG. 7 is another end view of the arrangement shown in FIG. 6.
Figure 8:
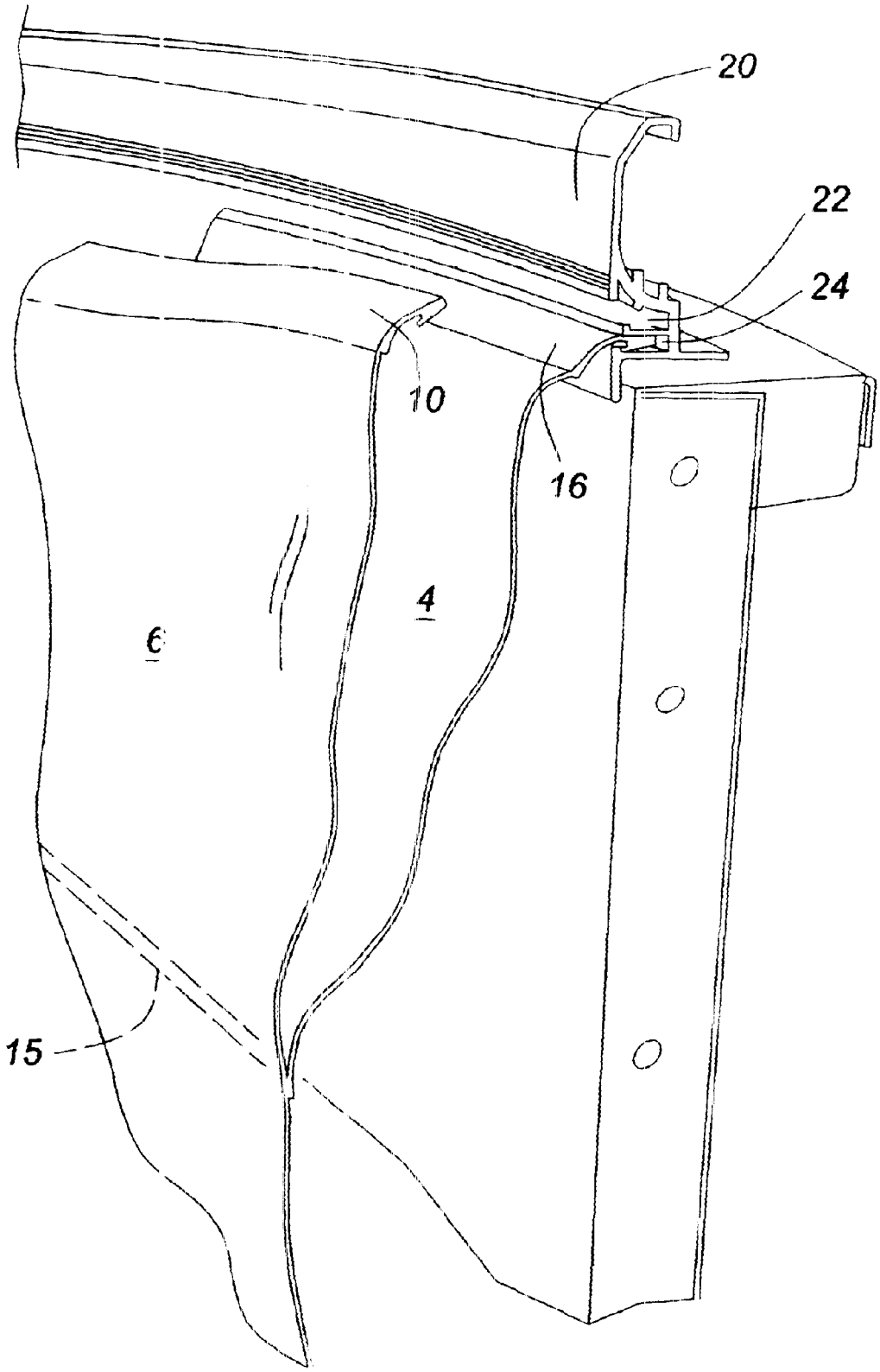
FIG. 8 is another perspective view similar to FIG. 6 but showing the upper end of the secondary liner removed from the coping.

As shown in FIGS. 6, 7 and 8, the upper clip 16 on the outer sheet 6 is removed from track 22 leaving the main sheet 4 with its upper clip 10 firmly engaged in the track 24.

Figure 9:
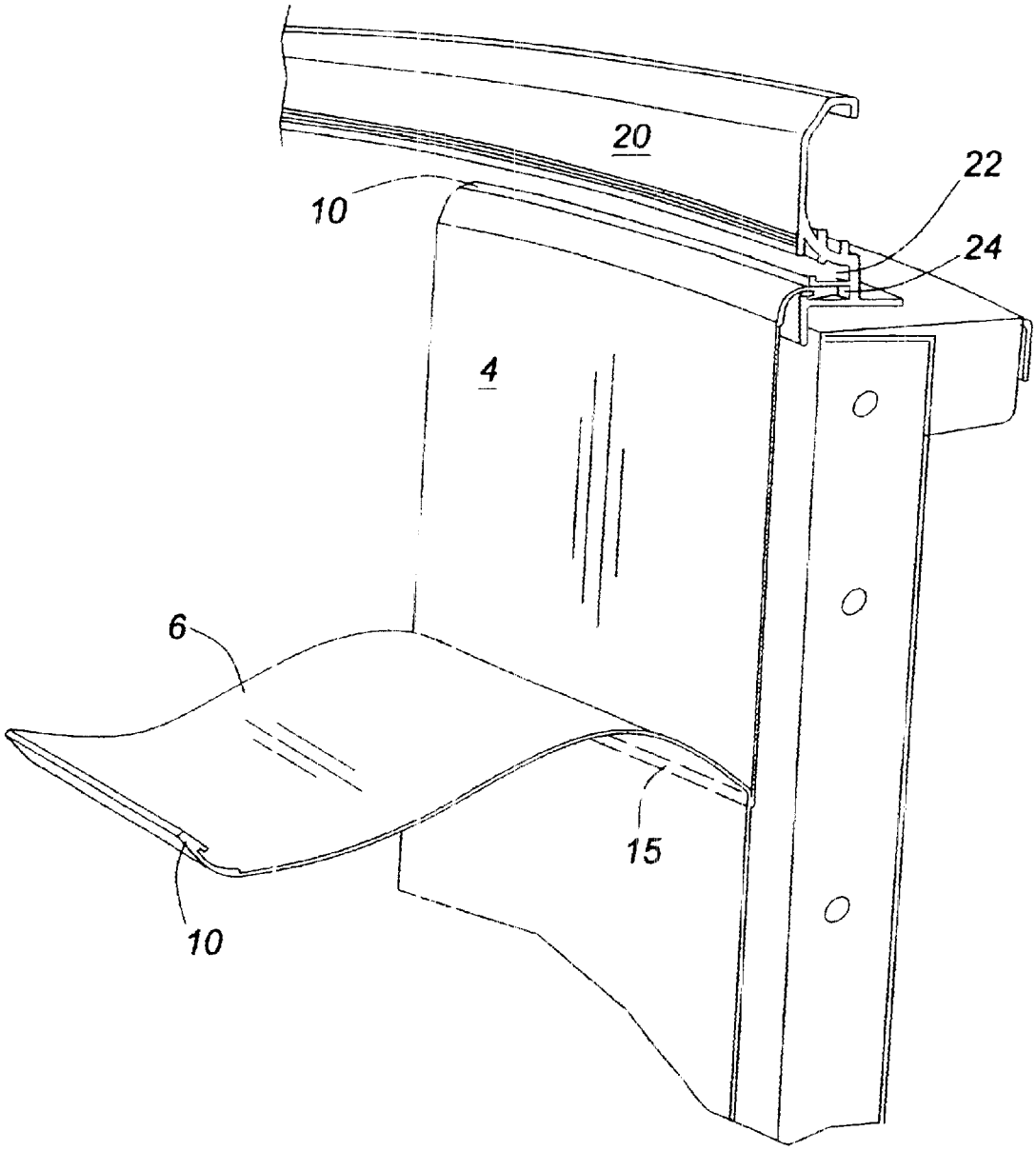
FIG. 9 is a view similar to FIG. 8 and showing the secondary liner detached from the coping.
Figure 10:
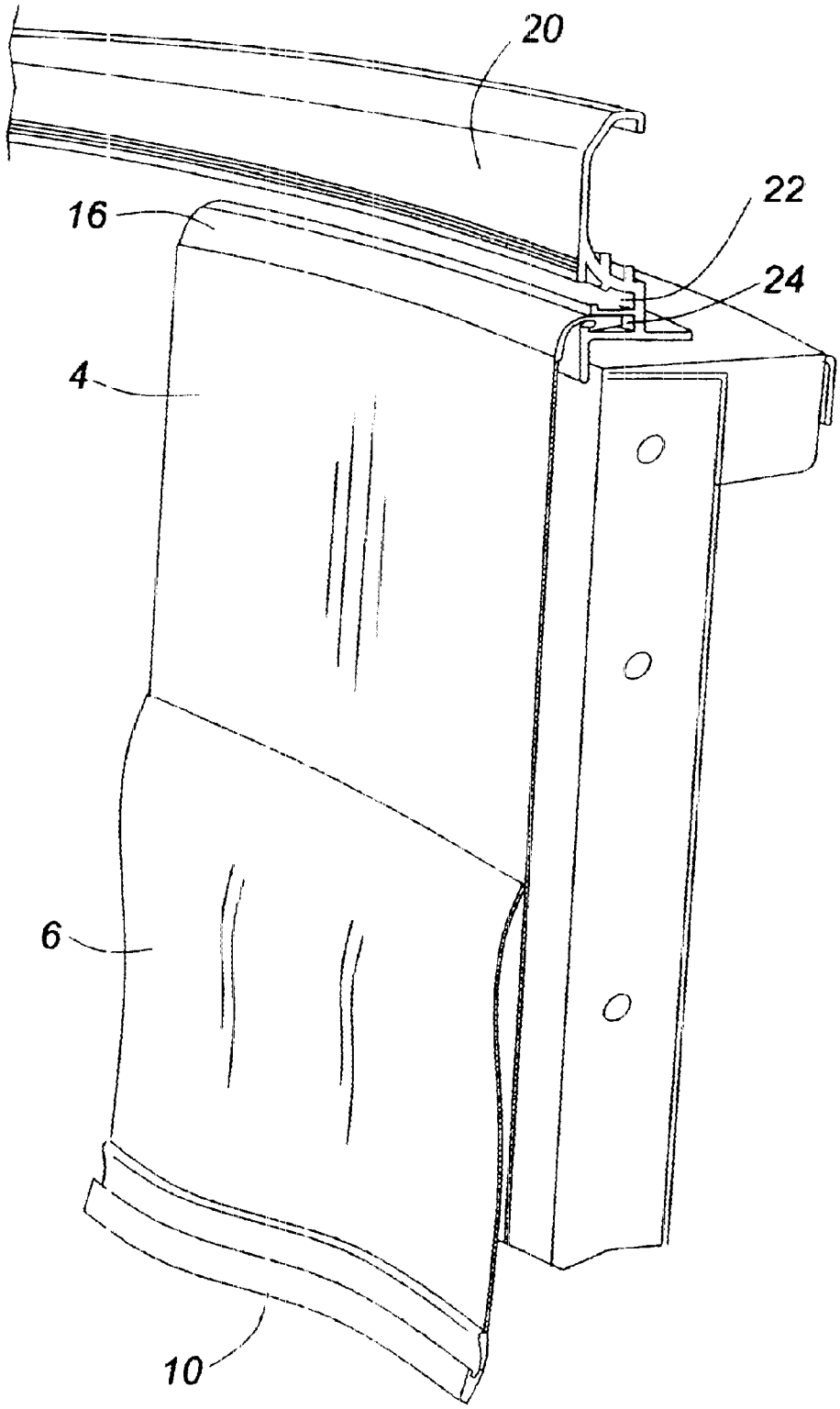
FIG. 10 is a further perspective view showing the secondary liner being retained by its heat seal to the main liner.
Figure 11:
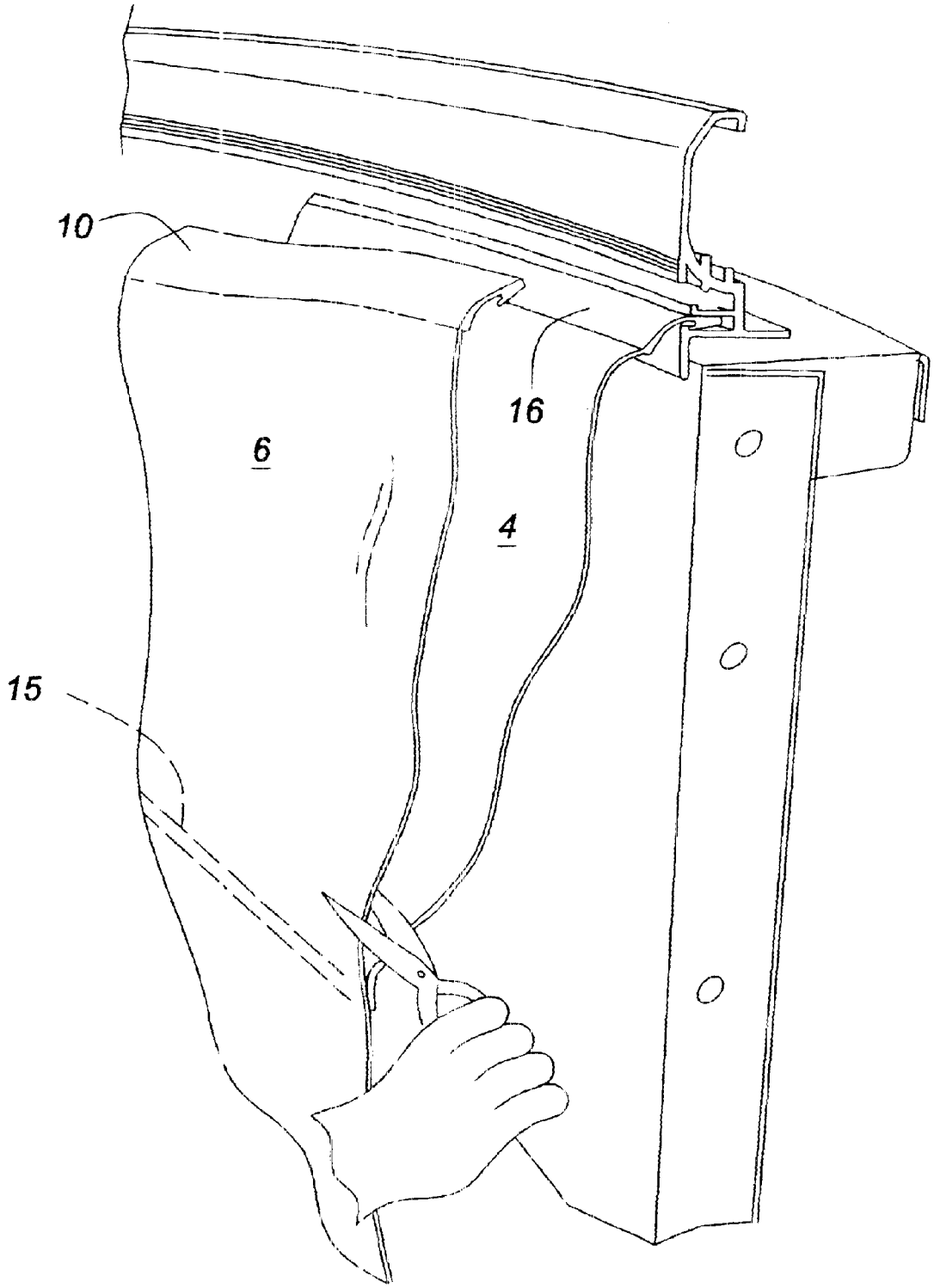
FIG. 11 shows the secondary liner being cut away from the main liner.

With the outer liner dropped away as shown in FIGS. 9 and 10, it can then be cut away as shown in FIG. 11 thereby leaving the main sheet intact and having an unworn upper surface exposed to the elements.

Figure 12:
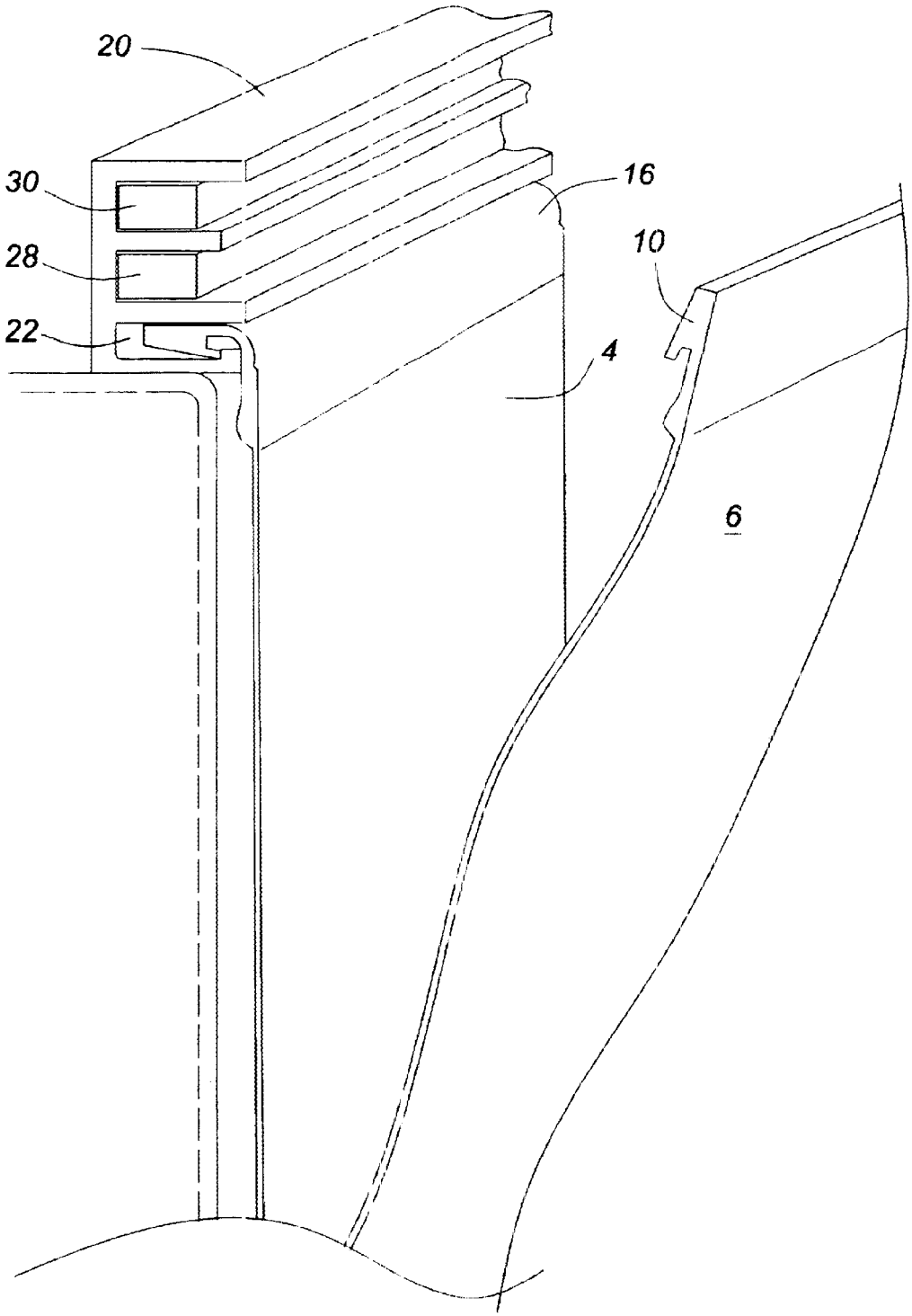
FIG. 12 discloses an alternate form of liner receptacle.

FIG. 12 shows the coping 20 having an alternate form of track 22, 28 and 30.

While the present invention has been described herein by the preferred embodiments, it will be understood to those skilled in the art that various changes may be made and added to the invention. The changes and alternatives are considered within the spirit and scope of the present invention.

What is claimed is:

1. A pool assembly comprising:

(a) a coping defining a pair of parallel adjacent channel each of said channels defining a locking flange;

(b) a main liner subassembly comprising a main liner sheet for lining the walls of a pool, and a main liner fasten top edge of the main liner sheet for fastening the main liner subassembly to a higher a one of the channels of the coping of the pool; and (c) a secondary liner subassembly comprising a secondary liner sheet overlapping at least 15 inches of the upper portion of the main liner sheet and having a bottom edge that is attached to a rear surface of the main liner sheet, and a secondary liner fastener at the top edge of the secondary liner sheet, for fastening the secondary liner subassembly to a lower of the channels of the coping of the pool wherein the second liner is attached to the main liner so that the secondary liner fastener is configured to be adjacent to the main liner fastener when the secondary liner assembly is in overlapping contact with the main liner.

2. The pool assembly of claim 1 wherein the main liner sheet and secondary liner sheet are made from a vinyl material.

3. The pool assembly of claim 2 wherein the bottom edge of the secondary liner sheet is attached to the main liner sheet by a heat seal.

4. The pool assembly of claim 3 wherein the main and secondary liner fasteners are flexible clips for clipping into respective tracks of the coping.

5. A pool assembly comprising:

(a) a main liner subassembly comprising a main liner sheet for lining the walls of a pool, and a main liner fastener at the top edge of the main liner sheet for fastening the main liner subassembly to a coping of the pool above a pool water level;

(b) a secondary liner subassembly comprising a secondary liner sheet overlapping at least 15 inches of the upper portion of the main liner sheet and having a bottom edge that is attached to the main liner sheet, and a secondary liner fastener at the top edge of the secondary liner sheet, for fastening the secondary liner subassembly to the coping of the pool;

(c) wherein the main and secondary liner fasteners are flexible clips for clipping into respective tracks of the coping, and wherein the secondary liner sheet is attached to the back surface of the main liner sheet such that an upper portion of the main liner sheet covers the secondary liner sheet and the secondary liner fastener.

6. A secondary liner for a pool liner assembly, comprising:

(a) a secondary liner sheet for overlapping an upper portion of a main liner sheet of the pool liner assembly and having a bottom edge that is attached to a surface of the main liner sheet;

(b) a secondary liner fastener at the top edge of the secondary liner sheet, for fastening the secondary liner to a coping of a pool;

(c) wherein the secondary liner sheet is made of a vinyl material, and wherein the secondary liner fastener is a flexible clip for clipping onto a track of the coping, and wherein the secondary liner sheet is attached to the back surface of the main liner sheet such that an upper portion of the main liner sheet covers the secondary linear fastener and the secondary liner sheet by more than 15 inches.

* * * * *

UNITED STATES PATENT AND TRADEMARK OFFICE

CERTIFICATE OF CORRECTION

PATENT NO. : 6,662,383 B2
DATED : December 16, 2003
INVENTOR(S) : Kerry J. Cornelius It is certified that error appears in the above-identified patent and that said Letters Patent is hereby corrected as shown below:

Title page,
Item [57], ABSTRACT,
Line 15, "*" should be -- a --;

Column 2,
Line 41, before "liner" insert -- main --;

Column 4,
Line 5, before "along" insert -- continuously --;

Column 5,
Line 10, "channel" should be -- channels --;
Line 14, "fasten" should be -- fastener at the --;
Line 15, after "higher" delete "a";
Line 24, after "lower" insert -- one --;
Line 25, "second" should be -- secondary --;

Column 6,
Line 1, after "pool" insert -- liner --;
Line 35, "linear" should be -- liner --.

Signed and Sealed this

Twenty-seventh Day of July, 2004

JON W. DUDAS
*Acting Director of the United States Patent and Trademark Office*